US005232392A

United States Patent [19]

Ortiz

[11] Patent Number: 5,232,392

[45] Date of Patent: Aug. 3, 1993

[54] TOY TRAPEZE ASSEMBLY

[76] Inventor: Alberto J. Ortiz, Apartado 6-5506 El Dorado, Industrias, Prima Panama, Panama

[21] Appl. No.: 841,099

[22] Filed: Feb. 25, 1992

[51] Int. Cl.[5] ..... A63H 13/12

[52] U.S. Cl. ..... 446/322; 446/901

[58] Field of Search ..... 446/322, 901, 139, 138, 446/137

[56] References Cited

U.S. PATENT DOCUMENTS

| | | | |
|---|---|---|---|
| 1,515,146 | 11/1924 | Clark | 446/322 |
| 2,445,387 | 7/1948 | Davis | 446/322 |
| 2,648,158 | 8/1953 | Young | 446/138 |

FOREIGN PATENT DOCUMENTS

| | | | |
|---|---|---|---|
| 1430513 | 3/1976 | United Kingdom | 446/901 |

*Primary Examiner*—Mickey Yu

*Attorney, Agent, or Firm*—Malloy & Malloy

[57] ABSTRACT

A toy trapeze assembly, to be used for amusement purposes, which includes a frame structure having movably attached thereto, by swing supports, a pair of horizontally oriented trapeze bars. The trapeze bars and swing supports are structured and disposed such that the bars swing in a generally pendulum like, horizontally oriented manner, thereby enabling a trapeze acrobat figure to be launched from a protruding peg on one trapeze bar, and caught, utilizing hook and loop fastener pads on the acrobat's arm and leg portions, by either a catcher acrobat, or a hook and loop fastener pad on the second bar.

15 Claims, 2 Drawing Sheets

TOY TRAPEZE ASSEMBLY

BACKGROUND OF THE INVENTION

1. Field of the Invention

This invention relates to a toy trapeze assembly adapted to be interactive and realistic, wherein toy acrobat figures are launched from swinging trapeze bars requiring true to life timing, thereby providing a user with an entertaining simulation of a real trapeze aerial show.

2. Description of the Prior Art

Trapeze aerial shows are an exciting and often favorite event of a circus. Most individuals have gone to, or have seen circuses, and consequently trapeze aerial shows, and are amazed and entertained. Consequently, it would be highly desirous for many circus fans to have a toy assembly which will accurately and enjoyably simulate a real life trapeze aerial show.

In the past, there have been many decorative uses of trapezes and acrobats, but none which are structured to actually simulate the high flying acrobatics involved. Prior designed trapeze decorations have been limited to a single trapeze and an acrobat permanently attached thereto. Accordingly, there is a need for a toy trapeze assembly which simulates the true acrobatic nature of the trapeze aerial show, namely high flying leaps from one trapeze bar to another trapeze bar or to a catcher acrobat thereon.

Applicant's invention is designed precisely to be a realistic interactive toy simulation of a trapeze aerial show, which necessitates proper timing and positioning, much like would be required by a real trapeze acrobat, in order to complete a successful jump. Further, applicant's design is safe, highly entertaining, and allows for a variety of adjustments, repositionings or variations for a jump.

SUMMARY OF THE INVENTION

The present invention is directed towards a toy trapeze assembly, to be used as a realistic, entertaining simulation of a real trapeze aerial show. The assembly includes a frame structure with support means thereon to maintain the structure in a stable, generally elevated, horizontal position. Further included in the assembly, are two horizontal trapeze bars. The trapeze bars are attached at opposite distal ends thereof to a pair of rigid swing supports. The rigid swing supports are removably secured at one of a plurality of spaced apart positions along the frame structure, and are structured and disposed such that the bars will swing in a generally pendulum like, horizontally oriented manner. Included on one of the trapeze bars are launching means. The launching means are structured such that a trapeze acrobat figure, releasably attached thereto, may be launched therefrom and towards the second trapeze bar, when the rigid swing supports engage a generally U-shaped stopper frame. Included on the second trapeze bar are catching means upon which the launched acrobat may be attached, or a catcher trapeze acrobat may be attached.

It is an object of the present invention to provide a realistic, and interactive simulation of a trapeze aerial show.

It is another object of the present invention to provide a toy trapeze assembly wherein trapeze acrobats are actually released from a trapeze bar and are caught at a second trapeze bar.

It is another object of the present invention to provide a genuine, entertainment simulation of the timing and positioning requirements of a trapeze aerial show.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
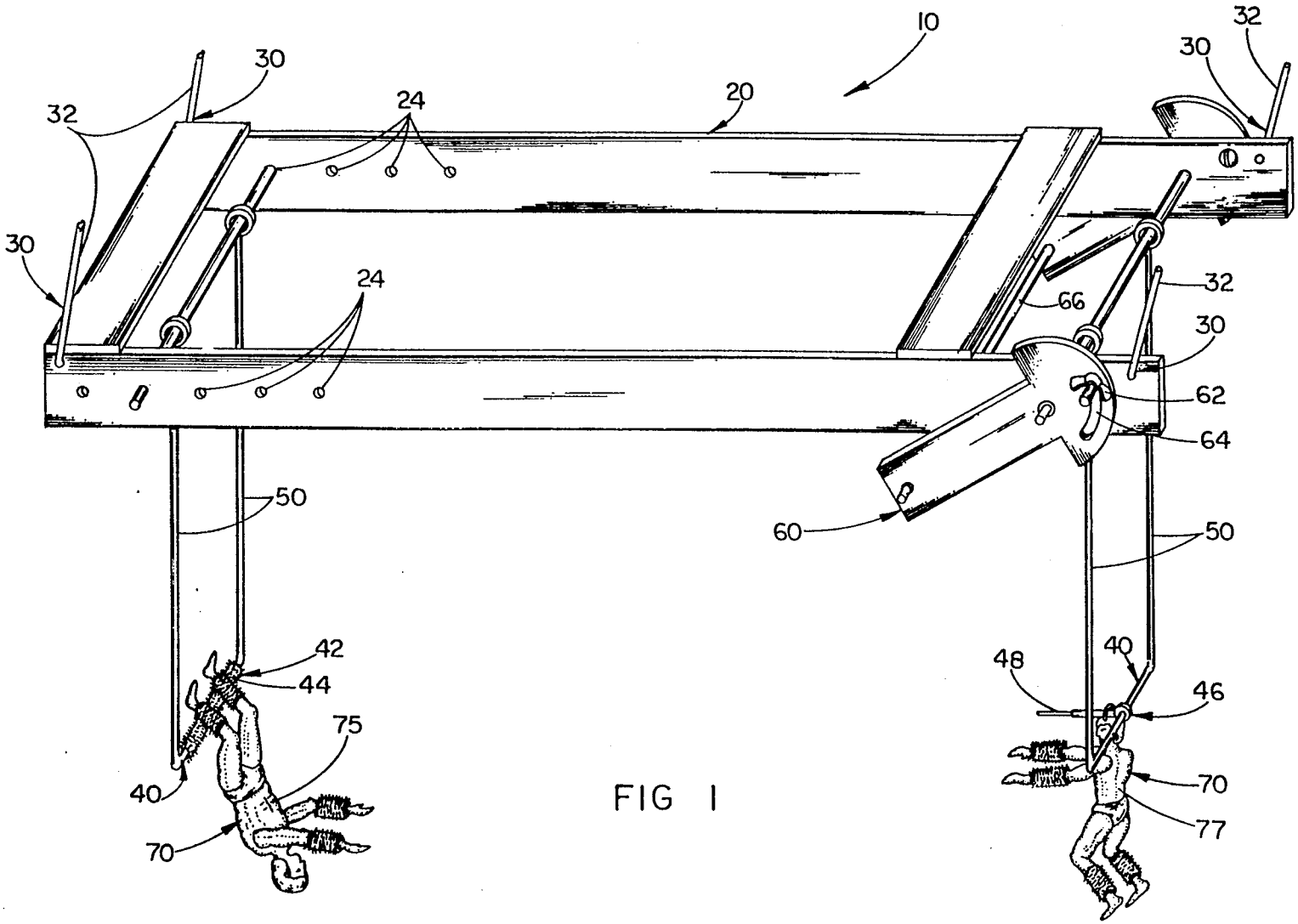
FIG. 1 is a perspective view of the toy trapeze assembly.

As shown throughout FIGS. 1 through 5, the present invention is directed towards a toy trapeze assembly, generally indicated as 10. As shown in FIG. 1, the trapeze assembly 10 includes primarily a frame structure 20 and a pair of trapeze bars 40. Each of the trapeze bars 40 are attached to the frame structure 20 by a pair of rigid swing supports 50. The rigid swing supports 50, which engage opposite distal ends of each of the trapeze bars 40, are removably positioned within one of a plurality of spaced apart apertures 24 in the frame structure 20, thereby allowing the distance and orientation of the trapeze bars 40 to be varied. The swing supports 50 are positioned such that the trapeze bars 40 swing in a generally pendulum like, horizontally oriented manner. Although the preferred embodiment utilizes rigid swing supports 50 for both trapeze bars 40, string or wire may be utilized on one of the trapeze bars to be designated as a catcher bar.

Attached to the trapeze bars 40 are either catching means 42 or launching means 46. Secured to the frame structure 20, near one of the trapeze bars 40 which has the launching means 46, is a generally U-shaped stopper frame 60. The U-shaped stopper frame 60 is adjustably secured to the frame structure 20 by tightening a wing nut 62 so as to effectively secure the stopper frame 60 at a desired position along an adjustment track 64 formed therein. The stopper frame 60 is positioned such that a cross bar 66 thereof will cause the swinging motion of the trapeze bar 40 including the launching means 46 to abruptly stop when the rigid swing supports 50 come into contact therewith. Accordingly, the abrupt stoppage caused by the cross bar 66 of the stopper frame 60 initiates the launching of an acrobat FIG. 70 from the launching means 46 of the trapeze bar 40 due to the continued momentum of the acrobat FIG. 77 in the direction of swing just prior to engagement of the bar 40 with cross bar 66. As noted, the positioning of the stopper frame 60 may be varied, thereby changing the launch point, and thus the trajectory of the launched acrobat FIG. 77.

Figure 2:
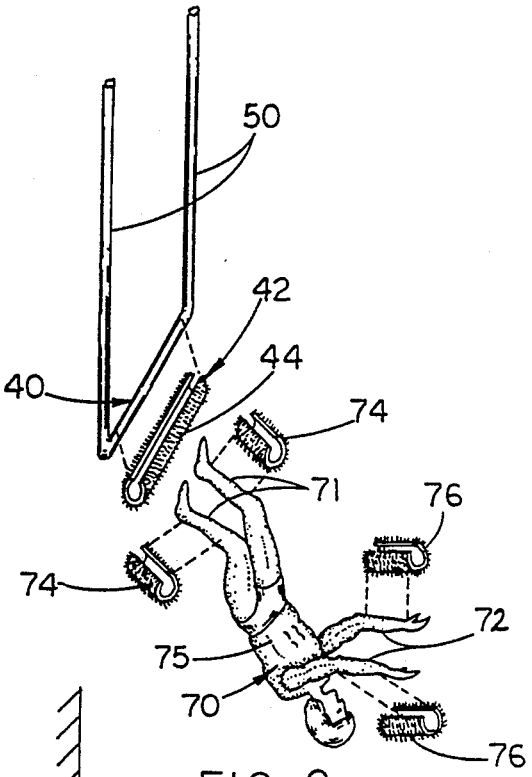
FIG. 2 is an exploded view, shown in perspective, of the catching trapeze bar and the catcher to be positioned thereon.

Turning to FIG. 2, the catching means 42 included on one of the trapeze bars 40 includes primarily a hook and loop fastener pad 44 secured about the trapeze bar 40. Further included, in the preferred embodiment, is a catcher acrobat 75. The catcher acrobat 75 includes hook and loop fastener pads 74 secured to the leg portions 71 thereof, which are structured and disposed to securely engage with the hook and loop fastener pad 44 on the trapeze bar 40, thereby causing the catcher acrobat 74 to be securely held on the trapeze bar 40 during swinging thereof. Further included on the catcher acrobat 75 are hook and loop fastener pads 76 fastened about movable arm portions 72 of the catcher acrobat 75. The hook and loop fastener pads 76 are substantially the same as the hook and loop fastener pad 44 secured about the trapeze bar 40.

Figure 3:
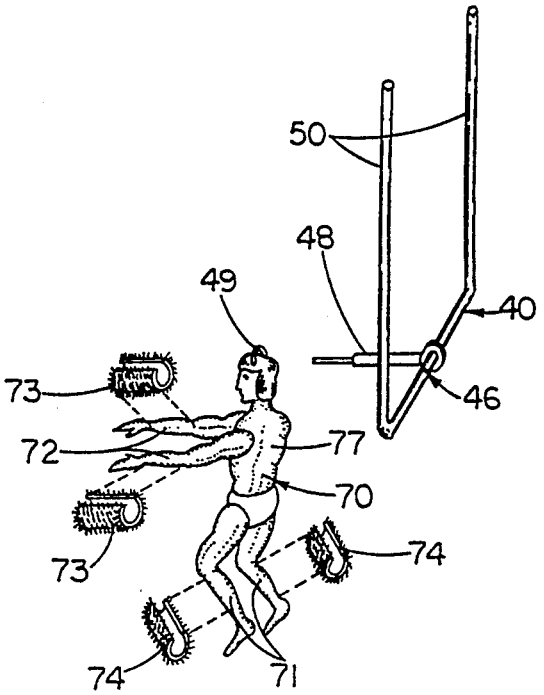
FIG. 3 is an exploded view, shown in perspective, of the launching trapeze bar with the acrobat to be launched thereon.

Turning to FIG. 3, the launching acrobat 77 is structured and disposed to engage either the hook and loop fastener pad 44 surrounding the trapeze bar 40 or the hook and loop fastener pads 76 on the arm portions 72 of the catcher 75. In order to engage the hook and loop fastener pad 44 or the hook and loop fastener pads 76 after being launched through the air, the launching acrobat 77 includes a pair of hook and loop fastener pads 73 secured about its movable arm portions 72, as well as hook and loop fastener pads 74 secured about the leg portions 71 thereof. Accordingly, either the arm portions 72 or the leg portions 71 of the launcher 77 may be "caught" by the catcher 75 or the catching means 42 on the trapeze bar 40.

Further detailed in FIG. 3, are the launching means 46. The launching means 46 include and elongate, tapered, protruding peg 48 extending from the trapeze bar 40. The elongate peg 48 is structured and disposed such that it may slide through a generally U-shaped hook protruding from the back of the launching acrobat 77, thereby releasably attaching the launching acrobat 77 to the trapeze bar 40, while allowing facilitated launching of the launching acrobat 77 when the rigid swing supports 50 contact the cross bar 66 of the stopper frame 60.

Figure 4:
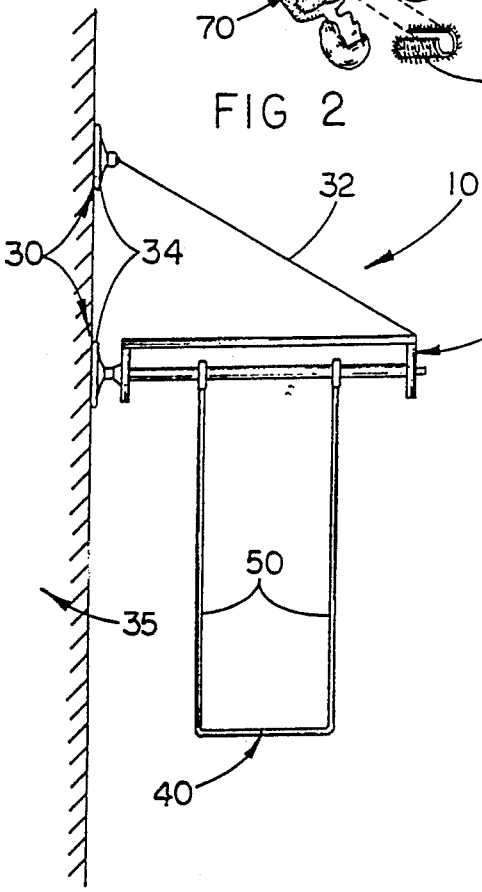
FIG. 4 is an end view of a second embodiment of the frame structure support means.
Figure 5:
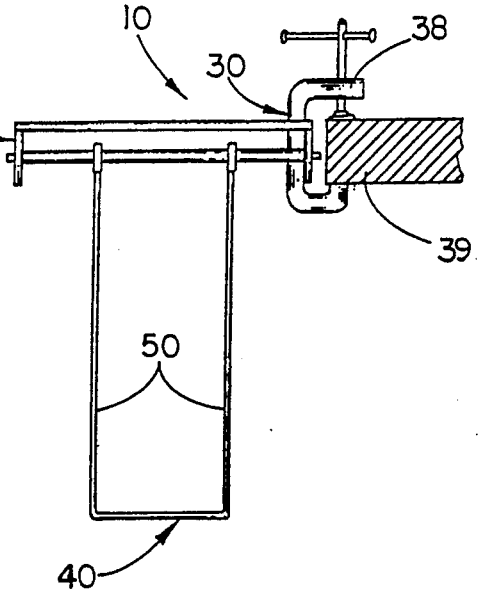
FIG. 5 is an end view of a third embodiment of the frame structure support means.

In order to maintain the frame structure 20, and thus the entire toy trapeze assembly 10 in a stable, horizontal, elevated position, support means 30 must be utilized. As shown in FIG. 1, the support means 30 may include a plurality of strings or wires 32 attached at the corners of the frame structure 20, which may be secured to a wall, a ceiling, or any other stable structure. Additionally, as shown in FIG. 4, the support means 30 may include a plurality of suction cups 34 to allow stable and facilitated securing to a wall 35. Finally, and as detailed in FIG. 5, the support means 30 may include a clamp 38 structured and disposed to secure the frame structure 20 to a table 39 or like surface.

It should be noted that the particular features recited may be varied and are not to be limited except as set forth in the claims and within the doctrine of equivalents.

Now that the invention has been described,

What is claimed is:

1. A toy trapeze assembly comprising:

a frame structure, support means to maintain said frame structure in a stable, generally elevated, horizontal position, at least two horizontal trapeze bars, at least two trapeze acrobat figures, including a launching acrobat and a catcher acrobat, means on said acrobat figures for releasably securing said acrobat figures to said horizontal trapeze bars, a pair of swing supports engaging opposite distal ends of each of said trapeze bars and being removably and swingably securable in spaced apart relation from one another to said frame structure such that said bars swing in a generally pendulum-like, horizontally oriented manner, a first one of said trapeze bars including launch means thereon, said launch means being structured and disposed to releasably secure said launching acrobat to said bar for subsequent launching of said launching acrobat upon interrupted forward progression of said trapeze bar, a second one of said trapeze bars including catching means thereon, said catching means being structured and disposed to receive and maintain one of said acrobats on said trapeze bar, and a generally U-shaped stopper frame being adjustably secured to said frame structure and being positioned such that said rigid swing supports of said trapeze bar having said launching means thereon will contact said stopper frame, thereby abruptly interrupting the forward, swinging progression of the swing supports and initiating a launching of said launching acrobat figure from said launching means.

2. A trapeze assembly as recited in claim 1 wherein said swing supports are rigid.

3. A trapeze assembly as recited in claim 2 wherein at least one of said swing supports is structured to be removably secured at a plurality of spaced positions along said frame structure.

4. A trapeze assembly as recited in claim 1 wherein said catching means includes a hook and loop fastener pad secured about said bar having said catching means thereon.

5. A trapeze assembly as recited in claim 4 wherein said catcher is removably secured to said catching means by hook and loop fastener pads secured about leg portions of said catcher.

6. A trapeze assembly as recited in claim 5 wherein said catcher further includes hook and loop fastener pad, being substantially the same as said hook and loop fastener pads of said catching means, about movable arms portions thereof.

7. A trapeze assembly as recited in claim 6 wherein said means for releasably attaching said launching acrobat to said bar includes hook and loop fastener pads secured about leg and arm portions of said acrobat figure, structured and disposed to engage with said hook and loop fastener pads of said catching means or on said arm portions of said catcher acrobat.

8. A trapeze assembly as recited in claim 7 wherein said means for releasably attaching said launching acrobat to said bar includes a generally U-shaped protruding loop extending from said launching acrobat; which is structured and disposed to slidably engage said launch means.

9. A trapeze assembly as recited in claim 8 wherein said launch means includes a generally elongate protruding peg over which said U-shaped protruding loop on said launching acrobat may pass, said peg being structured and disposed such that when said rigid supports contact said stopper frame said launching acrobat will be launched off of said peg.

10. A trapeze assembly as recited in claim 9 wherein said support means includes a plurality of elongate wires.

11. A trapeze assembly as recited in claim 9 wherein said support means includes a plurality of strings.

12. A trapeze assembly as recited in claim 10 wherein said support means includes a plurality of suction cups.

13. A trapeze assembly as recited in claim 9 wherein said support means includes a plurality of rigid, elongate, support members.

14. A trapeze assembly as recited in claim 9 wherein said support means includes a plurality of clamps.

15. A trapeze assembly as recited in claim 11 wherein said support means includes a plurality of suction cups.

* * * * *